United States Patent [19]

Merges

[11] 3,949,766

[45] Apr. 13, 1976

[54] HAIR CURL CLIP

[76] Inventor: Heinz Merges, Sudermannplatz 3, 5 Cologne, Germany

[22] Filed: Oct. 30, 1974

[21] Appl. No.: 519,110

[30] Foreign Application Priority Data

Nov. 2, 1973 Germany ..... 2354709

[52] U.S. Cl. ..... 132/46 A; 132/36 R

[51] Int. Cl.[2] ..... A45D 8/00

[58] Field of Search ..... 132/46 A, 46 R, 36, 41, 132/40, 42, 39, 33, 37 R; 219/24

[56] References Cited

UNITED STATES PATENTS

| | | | |
|---|---|---|---|
| 1,018,673 | 2/1912 | Madsen | 132/37 R |
| 1,554,800 | 9/1925 | Dodge, Jr. | 132/36 R |
| 2,777,451 | 1/1957 | Kriesman et al. | 132/36 R |
| 2,862,507 | 12/1958 | Hawthorne | 132/36 R |

*Primary Examiner*—G. E. McNeill

*Attorney, Agent, or Firm*—Diller, Brown, Ramik & Wight

[57] ABSTRACT

This disclosure relates to a clip for setting a preformed hair curl including a pair of jaws pivotally united for motion toward and away from each other with means for biasing the jaws toward each other, a heat-storing element carried by only one of the jaws, and the other of the jaws being formed as at least a pair of prongs to hold the hair curl between the pair of prongs and the heat-storing element.

12 Claims, 6 Drawing Figures

HAIR CURL CLIP

The present invention is directed to a clip for setting a pre-formed hair curl which includes a heat-storing element carried by only one of a pair of jaws biased toward each other with the other jaw being formed as a pair of prongs thereby to hold the hair curl between the prongs and the heat-storing elements such that the hair curl will be "set" due to the heat emitted by the heat-storing element.

Conventional curl clips of the type to which the present invention is directed are generally employed when the strands or ends of hair are too short for cylindrical curlers or is not intended to shape one's hair as that attainable by such cylindrical curlers. In order that such conventional clips will have the desired curl-setting effect, both for damp and dry hair, provision has been made in the past for a clip in which both jaws thereof which are pivotally joined to each other and biased for motion toward each other include a hollow chamber in each of which is received a heat-storing element. Due to the generally round configuration of the jaws each possesses the drawback that they do not satisfactorily clamp upon spirally wound hair strands and do not extend far enough over or upon a curl of hair in order to fully utilize the heating effect of the heat-storing element. This disadvantage results in curl slippage and due to the latter the desired shape of the eventually set curl is not obtained.

In keeping with the present invention a principal underlying aspect thereof is to provide a clip of the type aforementioned which, however, will appreciably more securely grip the formed curl between at least a pair of prongs and a heat-storing element so that virtually the entire amount of heat emitted from the heat-storing element is utilized for setting the curl. Moreover, the clip can be economically manufactured as a result of its simple construction, the latter fact being evidenced hereinafter in the more specific description of this invention.

In further keeping with this invention the heat-storing element is relatively stationarily though removably carried by but one of the jaws of the clip whereas the other jaw is formed as at least a pair of prongs which, as noted earlier, holds the clamped curl pressed flat against the heat-storing element. By virtue of the fact that the pair of prongs do not include a heat-storing element the hair of the curl is firmly gripped and held in shape by virtue of the fact that it is clamped between the heat-storing element and the prongs of the opposing clamping jaw. Due to this construction the invention affords the possibility of quickly freshening up a hair sytle, curling strands and ends even when the hair is dry, and setting any desired curl pattern by means of the cooperative inner action of the pronged jaw and the opposing heat-storing element. The latter combination collectively brings about an acceleration in the shaping of a strand or curl of hair into a permanent or set curl. Moreover, the clip is simple to handle, requires a little room both when in use and when stored, and due to being of low weight it is also highly suitable for traveling.

A further object of this invention is to provide a clip of the type heretofore set forth wherein the heat-storing element can be removed and reapplied to one jaw of the clip to permit the heat-storing element to be heated apart from the clip yet when in use both the two jaws and the heat-storing element are virtually a one-part article.

In further accordance with this invention the jaw of the clip associated with the heat-storing element may be constructed as a hollow member defining a chamber within which may be disposed the heat-storing element formed as a precast or preformed solid element or a medium which can be poured into the chamber and permitted to set to a relatively rigid form. In the case of forming the heat-storing element as a separate and removable component of the clip there is provided the additional advantage that the heat-storing element can be heated separate and apart from the clip, and in the latter case the heat-storing element may be provided with a central aperture in order that it might be telescoped upon a hot post to conductively or through convextion heat one or more of the heat-storing elements prior to the use thereof with associated clips.

In further accordance with this invention the heat-storing element is provided with groove means or like indentations in an edge thereof which can be engaged by the prongs of a jaw of the clip. In this manner the heat-storing element is positively connected to the prongs of one jaw of the clip in such manner that a major heated surface thereof lies in a plane which is generally parallel to the remaining jaw plane in the clamped position of the clip so that hair which is to be curled disposed therebetween is uniformally clamped and uniformally heated during whatever time period is necessary for obtaining a desired set.

With the heat-storing element being of a circular configuration and having an outwardly opening groove in its periphery the prongs of one jaw of the clip can grasp the heat-storing element in a tangential fashion which provides the advantage that the connection is easily effected and slippage is avoided, which might otherwise occur because of the virtual impossibility of inacurately introducing the prongs of the jaw into the groove of the heat-storing element. Preferably in order to improve the connection between the prongs and the heat-storing element, the cross section of the groove and prongs are correspondingly contoured thereby assuring a frictional purchase or grip between these parts thus effecting reliable handling during application and use.

Though the shape of the heat-storing element can, as required, be of various configurations it is preferably circular but may be oval or angular, and may include one or more corners.

With the above and other objects in view that will hereinafter appear, the nature of the invention will be more clearly understood by reference to the following detailed description, the appended claimed subject matter, and the several views illustrated in the accompanying drawing.

Figure 1:
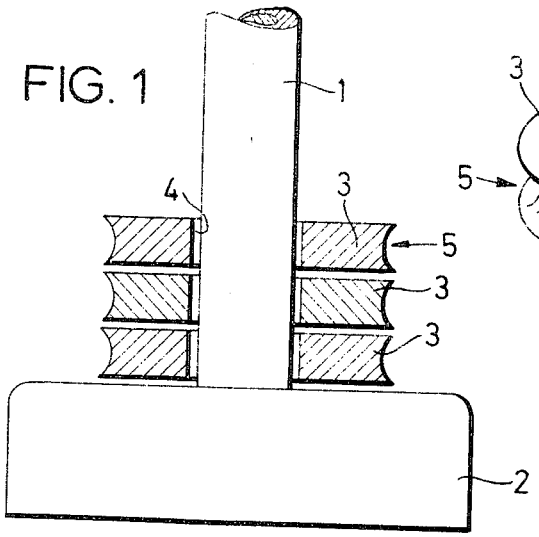
FIG. 1 is a fragmentary side elevational view with parts shown in cross section, and illustrates a plurality of apertured heat-storing elements superimposed relative to each other in telescopic relationship to a heated post.
Figure 2:
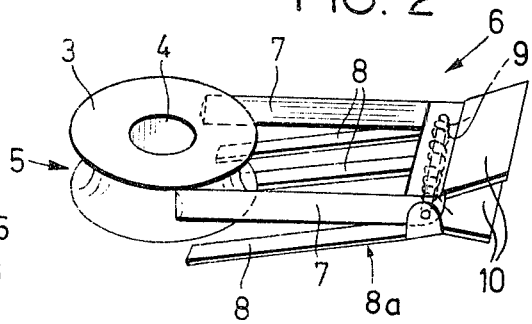
FIG. 2 is a prespective view of a novel clip constructed in accordance with this invention, and illustrates the manner in which a heat-storing element is assembled to a pair of prongs forming one jaw of a pair of jaws of the clip.

Reference is first made to FIG. 1 of the drawing which illustrates a plurality of heat-storing elements 3 which are disposed in superimposed relationship to each other and by virtue of apertures 4 therein are in external telescopic relationship to a post 1 which is preferably electrically heated. The post 1 may be connected to a base 2 which may, if desired, be insulated from the electrically conductive heated post 1. Each of the heat-storing elements 3 are generally circular (FIG. 2) and in addition to the circular apertures 4 in each to accommodate the post 1, a peripheral groove 5 is formed in an edge (unnumbered) thereof. The purpose of the groove 5 is to facilitate the connection of the heat-storing element 3 with associated prongs, 7, 7 (FIG. 2) of a clip having one jaw in the form of the prongs 7, 7 and another jaw 8*a* in the form of a plurality of prongs 8. The jaw 7, 8, with the latter being collectively indicated by the reference numeral 8*a*, are pivoted to each other in a conventional manner and are spring biased toward one another by a spring 9. Handles 10 are provided each jaw 7, 8*a* such that upon squeezing the handles 10 toward one another the jaws 7, 8*a* open away from each other and upon the release of the handles 10 the bias of the spring 9 urges the jaws 7, 8*a* toward each other generally to the position shown in FIG. 3.

Figure 3:
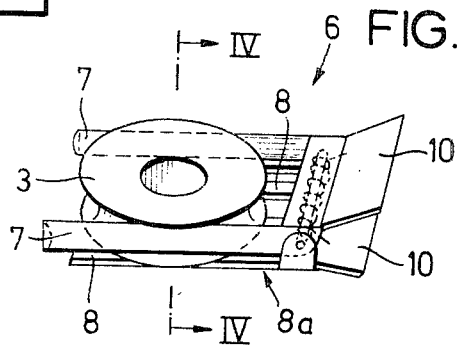
FIG. 3 is a perspective view of the clip of FIG. 2, and illustrates the finally assembled position of the heat-storing element and the two prongs of the clip.
Figure 4:
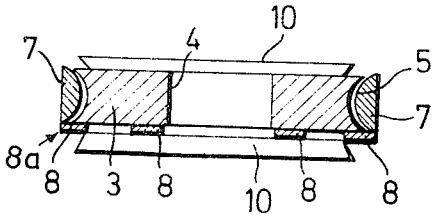
FIG. 4 is a slightly enlarged sectional view taken generally along the line of IV—IV of FIG. 3, and illustrates the manner in which the prongs which grip a periphery of the heat-storing element or contoured generally similarly thereto.

The jaw 7 or the prongs 7, 7 thereof are spaced from each other a distance corresponding to the minor diameter of the groove 5 of each heat-storing element and opposing surfaces (unnumbered) of the prongs 7, 7 are contoured to the configuration of the groove 5, in the manner most readily apparent from FIG. 4. The heat-storing element 3 can therefore be readily slid between the prongs 7, 7 in the manner initially illustrated in FIG. 2 until the final position shown in FIG. 3 is achieved. Due to the dimensioning and the relatively resilient nature of the prongs 7, 7 the heat-storing element 3 is clamped relatively rigidly through removably between the prongs 7, 7 with the corresponding cross-sectional configuration of the prongs 7, 7 and the groove 5 assuring that these elements will not be readily separated unless such is done intentionally.

The prongs 8 of the lower jaw 8a are shown as being flat (FIG. 4) and each contacts the underside of the heat-storing element 3, although in use it is to be understood that the curl of hair is disposed between the prongs 8 and the undersurface (unnumbered) of the heat-storing element 3. In the latter case the biasing force of the spring 9 exerts on a preformed hair curl a clamping force which, with heat originating or eminating from the heat-storing element 3, leads to a permanent formation of curled hair into a desired "set". The spacing of the prongs 8 of the lower clamping jaw 8*a* is so selected that they can accommodate between themselves the heating post 1, as is most apparent from FIG. 4, in order that the entire clip 6 including the heat-storing element may be positioned upon the heated post 1, as opposed to the separate assembly of the heat-storing element thereupon, in the manner heretofore discussed relative to FIG. 1.

Figure 5:
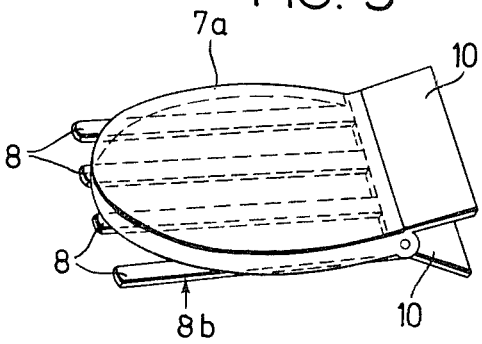
FIG. 5 is a perspective view of another clip constructed in accordance with this invention, and illustrates one of the jaws being formed as a heat-storing element and the other jaw being formed as a plurality of prongs.

If the heat-storing elements 3 are separately placed upon the heated post 1 in the absence of the clip 6 the clip 6 may be used to remove each heat-storing element from the post 1 without the danger of being burned by one simply squeezing the handles 10 to open the jaws 7, 8a and moving the prongs 7, 7 generally tangentially relative to the groove 5 of an upper most one of the heat-storing elements 3 while embracing the heated post 1. When the prongs 7, 7 are pushed forward far enough for the heat-storing element to be securely held therebetween the clip may then simply be lifted until the selected and secured heat-storing element is removed from the post 1. The clip 6 with the heat-storing element 3 now securely retain between the prongs 7, 7, as shown in FIG. 3, may be applied to a pre-formed hair curl with the heat-storing plate or element 3 being located to the outside of the hair line or scalp and the jaw 8*a* toward the inside or most closely adjacent the hair line or scalp. Thus danger of over heating one's head is totally precluded, since, as noted earlier, the prongs 8 of the jaw 8a are not hid but simply function to grip a curl between the same and the undersurface of the heat-storing element 3. The embodiment of the invention in FIGS. 1 through 4 illustrates the separate construction of the heat-storing elements 3 and the clip 6. However, in accordance with the invention shown in FIG. 5 the jaw 7*a* itself is formed of heat-storable material in the form of a solid plate as, for example, ferrous metal, copper, or the like. The jaws 7*a* is, as in keeping with the embodiment of FIGS. 1 through 4, pivotally and biasingly attached to a second jaw 8*b* having a plurality of prongs 8 which are the same or varying lengths. However, in this case in order to heat the jaw 7*a* which in a sense is the heat-storing element of the embodiment of the invention shown in FIG. 5, the upper surface (unnumbered) of the jaw 7*a* may be laid upon a flat heating surface or inserted into a heating slot of a heating device. Obviously the clip may also be clamped upon a heating plate, but in all cases the heat-storing element or jaw 7*a* may be rapidly heated due to its relatively large area which is exposed to a heating source and which additionally accelerates the setting process when in use.

Figure 6:
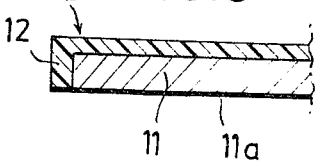
FIG. 6 is a fragmentary sectional view of a jaw of another clip constructed in accordance with this invention, and illustrates the manner in which the jaw is formed as a housing for receiving therein a heat-storing element.

FIG. 6 illustrates another embodiment of the invention in which a clamp or jaw portion 7*b* includes a core 11 of heat-storing material embedded or housed in a insulating housing 12 formed of plastic or like material. A surface 11*a* of the heat-storing element 11 will therefore permit heat to eminate therefrom and set an associated curl.

While preferred forms and arrangements of parts have been shown in illustrating the invention, it is to be clearly understood that various changes in detail and arrangement of parts may be made without departing from the spirit and scope of this disclosure.

I claim:

1. A clip for setting a preformed hair curl comprising a pair of jaws, means pivotally uniting said jaws for pivotal movement toward and away from each other, means for biasing said jaws toward each other, means consisting solely of a plate for storing heat and dissipating such stored heat to a preformed hair curl for setting the latter, said plate being carried by only one of said jaws, and an entire curl-contracting surface of said plate being in opposing relationship to a second of said jaws.

2. The clip as defined in claim 1 wherein said plate has a central aperture for receiving a heated post.

3. The clip as defined in claim 1 wherein said one jaw and plate are a single one-piece of material.

4. The clip as defined in claim 2 wherein said one jaw includes a chamber defined by a one-piece integral end and peripheral wall, and said plate is housed within and fills said chamber.

5. The clip as defined in claim 4 wherein said plate and chamber are retained in assembled relationship by frictional engagement therebetween.

6. A clip for setting a preformed hair curl comprising a pair of jaws, means pivotally uniting said jaws for pivotal movement toward and away from each other, a heat-storing plate carried by one of said jaws, said one jaw includes clamping means for removably clampingly securing said heat-storing plate thereto, and said clamping means are a pair of arms between which is removably clampingly secured said heat-storing plate.

7. The clip as defined in claim 6 wherein said heat-storing plate includes groove means within which are received said pair of arms.

8. The clip as defined in claim 6 wherein said heat-storing plate has a central aperture for receiving a heated post.

9. The clip as defined in claim 7 wherein said groove means and pair of arms are complementary contoured.

10. The clip as defined in claim 7 wherein said heat-storing plate is generally circular in configuration, and said groove means is formed in a peripheral surface thereof.

11. The clip as defined in claim 7 wherein said heat-storing plate has a central aperture for receiving a heated post.

12. The clip as defined in claim 8 wherein said heat-storing plate is generally circular in configuration, and said groove means is formed in a peripheral surface thereof.

* * * * *

UNITED STATES PATENT AND TRADEMARK OFFICE

CERTIFICATE OF CORRECTION

PATENT NO. : 3,949,766

DATED : April 13, 1976

INVENTOR(S) : Heinz Merges

It is certified that error appears in the above-identified patent and that said Letters Patent are hereby corrected as shown below:

In line 4, Column 5, change "curl-contracting" to --curl-contacting--.

Signed and Sealed this

Fourteenth Day of September 1976

[SEAL]

*Attest:*

RUTH C. MASON
*Attesting Officer*

C. MARSHALL DANN
*Commissioner of Patents and Trademarks*